United States Patent [19]

Phillips, Jr.

[11] Patent Number: 4,548,586

[45] Date of Patent: Oct. 22, 1985

[54] OUTBOARD MOTOR MOUNTING DEVICE AND COMBINATIONS THEREWITH

[76] Inventor: Joel P. Phillips, Jr., P.O. Box 1063, Winter Park, Fla. 32790

[21] Appl. No.: 513,806

[22] Filed: Jul. 15, 1983

[51] Int. Cl.[4] ..... B63H 5/12

[52] U.S. Cl. ..... 440/6; 403/229; 440/53; 440/56

[58] Field of Search ..... 440/6, 7, 53, 56, 64, 440/65, 83; 248/640, 642, 298; 403/104, 229; 411/147

[56] References Cited

U.S. PATENT DOCUMENTS

| | | | |
|---|---|---|---|
| 866,616 | 9/1907 | Bollwahn | 411/147 X |
| 1,952,341 | 3/1934 | Ude | 440/6 X |
| 3,279,133 | 10/1966 | Korte | 403/229 X |
| 3,948,204 | 4/1976 | Brock et al. | 440/6 |

*Primary Examiner*—Sherman D. Basinger
*Attorney, Agent, or Firm*—Roger L. Martin

[57] ABSTRACT

An outboard boat motor utilizes a universal coupling between the upper section of a mounting device that is attached to the hull of a boat and the lower section of the mounting device to which the motor and impeller are secured. The coupling permits universal lateral pivotal movement of one section relative to the axis of the other section and thus permits the submerged motor assembly to yield with an underwater obstruction is encountered. The universal coupling is formed in part by a coiled tension spring which is connected to the upper and lower sections of the mounting device for the boat motor through the use of convoluted members that are fixed to the sections and arranged between adjacent convolutions and at opposite ends of the spring. An arrangement involving small elements located in the opening of an annular portion of the upper section of the motor and which fit in suitable channel members that are mounted on the upper surface of the support member of a bow pulpit facilitate mounting of the device at the bow of a boat suitably equipped with a bow pulpit. As thus mounted, the motor may be used as an auxiliary motor during docking of the boat under adverse wind and/or current conditions.

10 Claims, 10 Drawing Figures

OUTBOARD MOTOR MOUNTING DEVICE AND COMBINATIONS THEREWITH

BACKGROUND OF THE INVENTION

The use of electrically powered outboard boat motors for trolling for fish is known. See Blanchard, U.S. Pat. No. 4,311,470, issued Jan. 19, 1982; Osborne, U.S. Pat. No. 3,598,947, issued 08/10/71; Creager, U.S. Pat. No. 3,861,628, issued 01/21/75; and Harris, U.S. Pat. No. 3,602,181, issued 08/31/71. Such motors have a submersible electric motor that is drivingly connected to an impeller. In most cases such motors are mounted at the lower end of a vertically extending and laterally non-yielding structure that can be permanently damaged if the motor encounters a nonyielding underwater structure during use. Such motors may be mounted at various locations on the hull of the boat and, if mounted at the forward end or bow of the boat, are capable of use in thrusting the bow laterally as an auxiliary steering aid during docking of such boats under difficult wind and/or current condi- tions.

The need exists for a mounting device for such outboard motors and which protects the underwater motor assembly and the mounting device itself from damage when an underwater obstruction to the path of movement of the underwater motor assembly is encountered. Also needed is a practical and efficient device for mounting such underwater electric motor assemblies in the bow areas of boats which are equipped with a bow pulpit.

SUMMARY OF THE INVENTION

In accord with certain aspects of the invention, provisions are made to permit the submerged electric motor assembly upon encountering an underwater object to pivot away from its normal position of use along a vertical axis. The provisions are such that such pivotal movement may be universally directed in any lateral direction that is normal to the vertical axis. This is accomplished through use of a connection between upper and lower sections of a mounting device for the electrically powered motor assembly and which provides a universal coupling between the sections. The universal coupling, in accord with certain aspects of the invention, involves the use of a coil spring element and which provides a yieldable means that resists the lateral pivotal movement of the electric motor assembly and tends to urge the motor assembly back into its normal position along the vertical axis.

In accord with other aspects of the invention, the universal coupling involves the use of a pair of configured annular members which are used in connecting the coiled spring element to the upper and lower sections of the mounting device. Each of these annular members is configured to form a helical convolution which in the final assembly of the mounting device for the underwater motor is fixed to one of the sections and located between a pair of convolutions at one of the opposite ends of the coiled element. As such, between the annular configured members movement of the coiled spring is unobstructed so that not only is there a universal coupling between the sections of the mounting device which permits universal pivotal movement in a lateral direction but the spring serves to react to such pivotal movements and to urge the structure back into its normal position.

Still another aspect of the invention has to do with provisions for mounting the boat motor at the bow of a boat which is equipped with a bow pulpit. Here an annular component which fits over the supporting member of the bow pulpit and rests on the support member between the bow and the front end is used in suspending the motor assembly from the boat as will be subsequently seen.

A general objective of the invention is to provide an improved device for suspending the submersible electrically powered motor assembly of an outboard boat motor from the boat hull. Yet another object is to provide an improved mounting device for such motor assemblies and which yields and permits the motor assembly to pivot away from its normal suspended position when an underwater obstruction is encountered and regardless of which horizontal direction the boat is moving at the time of such encounter. Yet another object is to provide a simple, inexpensive means for suspending the submersible electrically powered motor assembly of an outboard boat motor and which serves to minimize and/or avoid damage to the boat motor when an underwater obstruction is encountered by the underwater parts of the boat motor. Still another object is to provide an aid for docking boats that are equipped with a bow pulpit and more particularly for docking such boats under adverse current and/or wind conditions. Still a further object is to provide a mounting device for an outboard boat motor of the kind contemplated herein and which permits the motor assembly to pivot laterally of a vertical axis extending through the normal position for the motor and in all directions that are normal to the axis, or in other words, throughout the 360°of rotation about the axis.

BRIEF DESCRIPTION OF DRAWINGS

The novel features which are believed to be characteristic of this invention are set forth with particularity in the appended claims. The invention, itself, however, both as to its organization and method of operation, together with further objects and advantages thereof, may best be understood by reference to the following description taken in connection with the accompanying drawings, wherein:

DETAILED DEESCRIPTION OF PREFERRED EMBODIMENT

Figure 1:
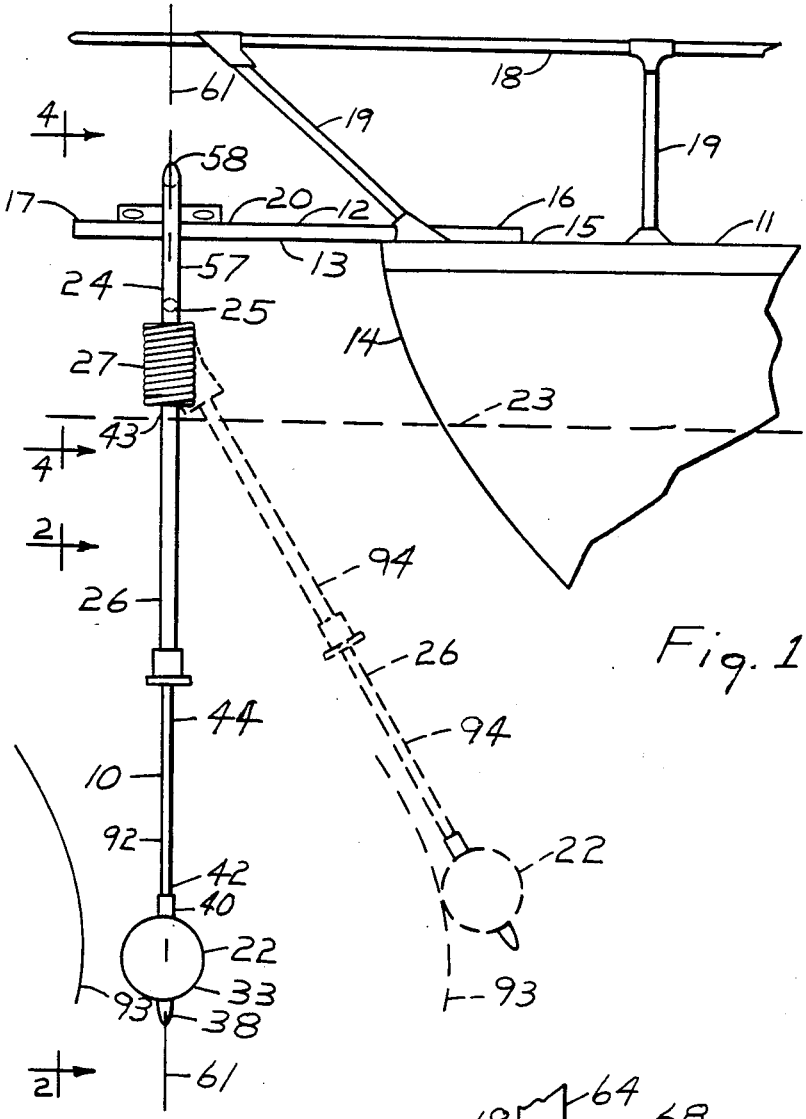
FIG. 1 is a view in side elevation showing a preferred embodiment of the outboard motor and as seen when attached to the bow pulpit of a boat that is seen with parts broken away, certain parts of the embodiment being shown in broken lines and in a position assumed when encountered by an underwater obstruction during movement of the boat.

An outboard boat motor embodying the improvements of the invention as seen in FIG. 1 in the form of an electrically powered outboard motor 10 that is used as an auxiliary motor for a boat 11 that is equipped with a bow pulpit 12. The motor in this instance is seen as temporarily mounted on the forwardly projecting support member 13 of the bow pulpit 12 and whereat it is temporarily attached and used to exert lateral thrust at the boat of the boat and as the boat is being docked. The arrangement, of course, enables the helmsman to use the auxiliary motor as a steering aid during such docking procedures.

Only a bow fragement of the boat 11 is seen in FIG. 1. The boat will be understood as having an impeller that is suitably powered and located at the stern of the craft in addition to the outboard boat motor 10 shown mounted in the bow 14 area of the craft.

The support member 13 of the bow pulpit 12 is an elongated, flat, horizontally arranged member that is fixed at its rear end to the deck 15 of the boat. The member 13 projects forwardly of the bow 14 and to its forward end which is designated at 17. The deck 15 is surrounded by a conventional overlying peripheral rail 18 that is supported spacedly above the deck 15 on suitable supports 19. These supports 19 incline forwardly at either side of the pulpit support member 13 so as to provide a suitable protective arrangement for the rail about the water overhanging support member 13.

The auxiliary motor 10 includes an electric motor assembly 22 which during use is submerged below the surface 23 of the water and a mounting device 24 for suspending the electric motor assembly 22 from the support member 13 of the bow pulpit 12. The mounting device 24 has an upper section 25 that is attachable to the boat 11 and a lower section 26 which is spaced apart from the upper section along an axis 61 and secured to the electric motor assembly 22 at its lower end. The mounting device 24 also includes a universal coupling 27 which is generally located between sections 25 and 26 along axis 61 and which interconnects the sections 25 and 26 in a manner such as to provide universal lateral pivotal movement of the lower section 26 with respect to the axis 61 as will be subsequently seen.

Figure 2:
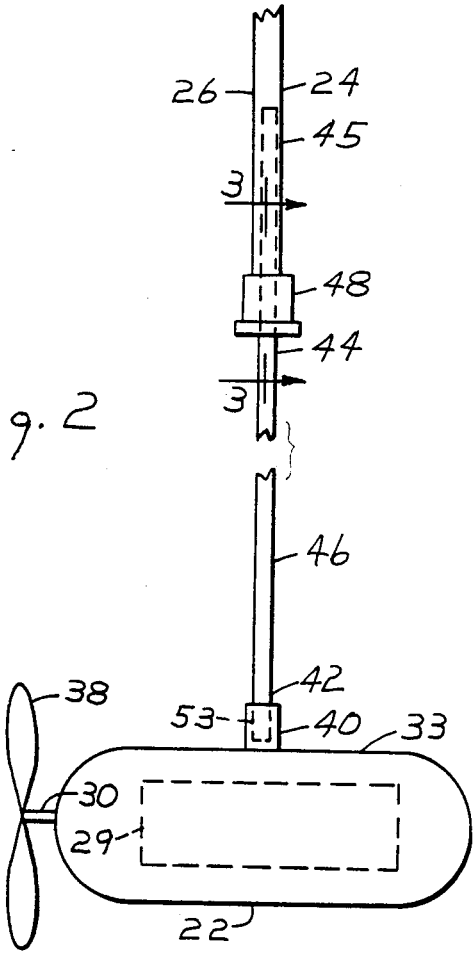
FIG. 2 is a front elevation of a fragment of the boat motor as seen along the Lines 2—2 of FIG. 1, the view being somewhat enlarged over that shown in FIG. 1.

Any suitable electrically powered motor assembly may be used. The assembly 22, as best seen in FIG. 2, includes a DC electric motor 29, a drive shaft 30 that is drivingly connected to an impeller 38 and a waterproof casing 33 in which the motor 29 is housed.

Figure 3:
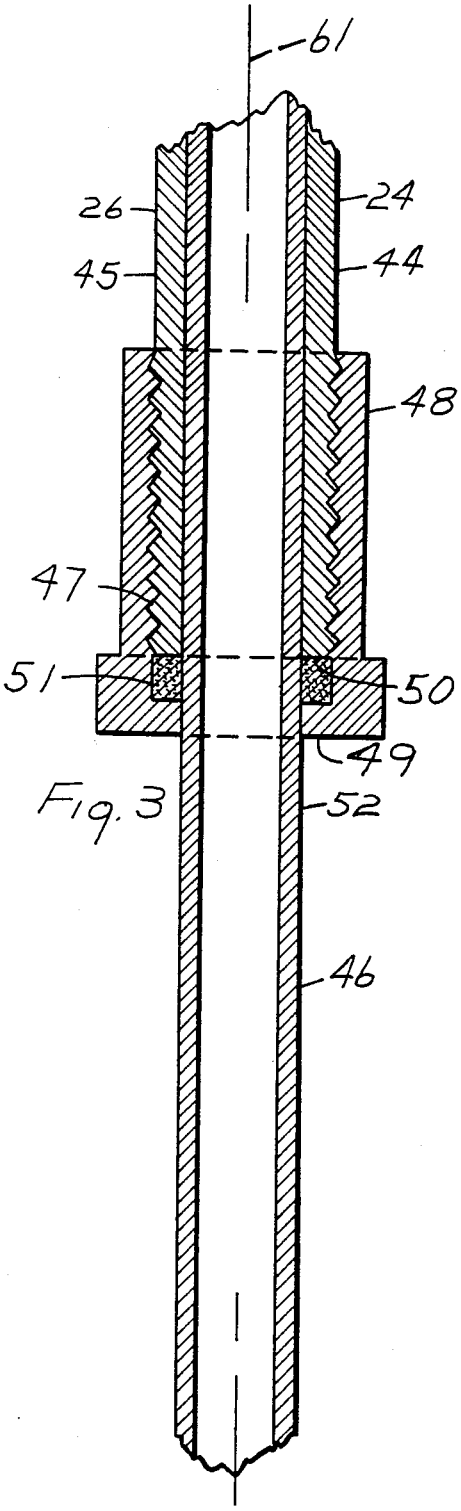
FIG. 3 is an enlarged vertical section taken generally along the Lines 3—3 of FIG. 2.

The structure of the lower section 26 of the mounting device 24 is best illustrated by reference to FIGS. 1, 2 and 3. Section 26 has opposite ends 42 and 43 (see FIG. 1) and comprises an elongated telescoping assembly 44. This assembly 44 includes an elongated tubular component 45 at the upper end 43 of the section and another elongated tubular component 46 at the lower end 42 of the assembly 44. These components 45 and 46 are coaxially arranged and component 46 is adapted and arranged to fit into the lower end 47 of tube component 45. Here at the lower end 47, tubular component 45 is equipped with external threads that are engaged by the internal threads of a sleeve component 48 of assembly 44 and which is equipped with a radially inwardly projecting annular flange 49 at its lower end. This flange 49 overlaps the annular lower end extremity 50 of tube component 45. A deformable and non-compressible annular element 51 is here positioned about the periphery of tube component 46 between the flange 49 and the end extremity 50 of tube 45 and the flange 49 of sleeve 48. This causes the element 51 to forcefully engage the outer wall 52 of tube 46 and thereby frictionally resist relative axial movement of one tube with respect to the other. The sleeve 48 and tube surrounding annular element 51 provide an adjustable means for securing the telescoping components against relative axial movement. The lower end 53 of tube component 46 is secured to and fits in a socket element 40 that is welded to the motor casing 33 as seen in FIG. 2. As such, the telescoping assembly 44 with its sleeve 48 and annular element 51 provide a means for adjusting the depth of submersion of the motor assembly 22 beneath the water surface 23. The annular element 51 may be made, for example, of asbestos or other suitable material.

Figure 4:
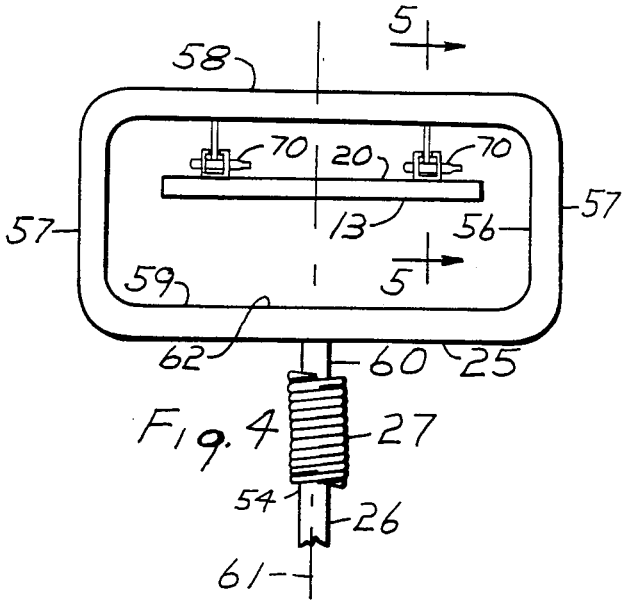
FIG. 4 is a front elevation of a fragment of the boat motor as seen along the Lines 4—4 of FIG. 1, the view being somewhat enlarged over that shown in FIG. 1.

The upper section 25 of mounting device 24 and the means by which it is attached to the boat is best illustrated in FIGS. 1, 4, 5, 6 and 7. As seen in FIG. 4, section 25 has a generally rectangularly shaped annular member 56 that includes vertically oriented opposite side members 57, a horizontally oriented top member 58, and a horizontally oriented bottom member 59 which intermediate the side members 57 is provided with a short depending tubular member 60 that establishes an axis 61 which is fixed with respect to the upper section 25. This axis is vertically oriented when the section 25 is attached to the boat 11 as will be evident from FIG. 1. The annular member 56 of section 25 and the support member 13 of the bow pulpit 12 are so arranged when the section 25 is attached to the boat 11 that the support member 13 extends through the opening 62 of member 56 and the latter rests upon the support member 13 between the bow 14 and the forward end 17 thereof.

In the opening 62 of annular member 56, the upper section 25 is equipped with a pair of elongated elements 63 that are respectively fixed to the lower ends of a pair of vertically extending members that are designated at 64. These members 64 are welded to the top member 58 and the arrangement is such that the elements 63 are horizontally and laterally spaced apart and also fixed in parallel in the opening 62 of the annular member 56.

Figure 7:
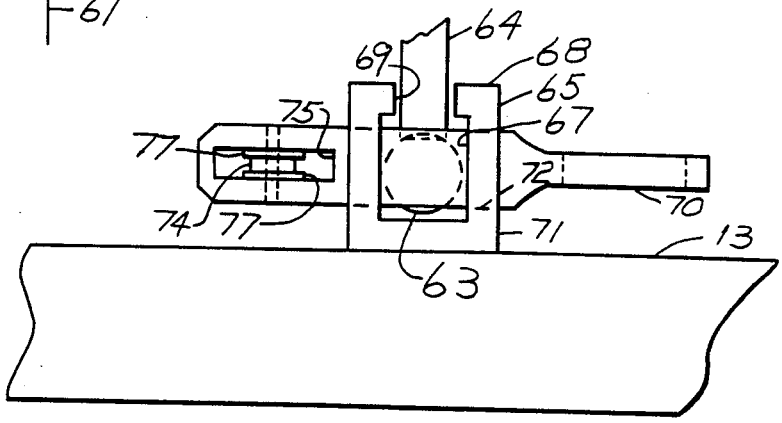
FIG. 7 is a sectional view in elevation taken generally along the Lines 7—7 of FIG. 6.
Figure 6:
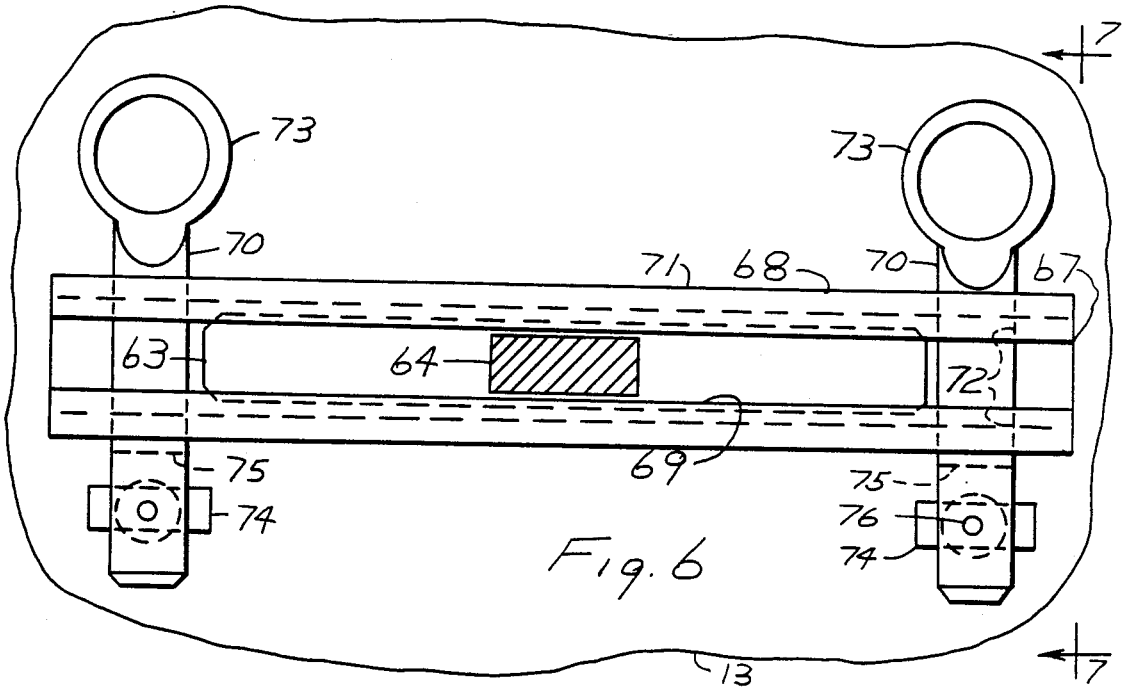
FIG. 6 is a horizontal sectional view taken generally along the Lines 6—6 of FIG. 5.
Figure 5:
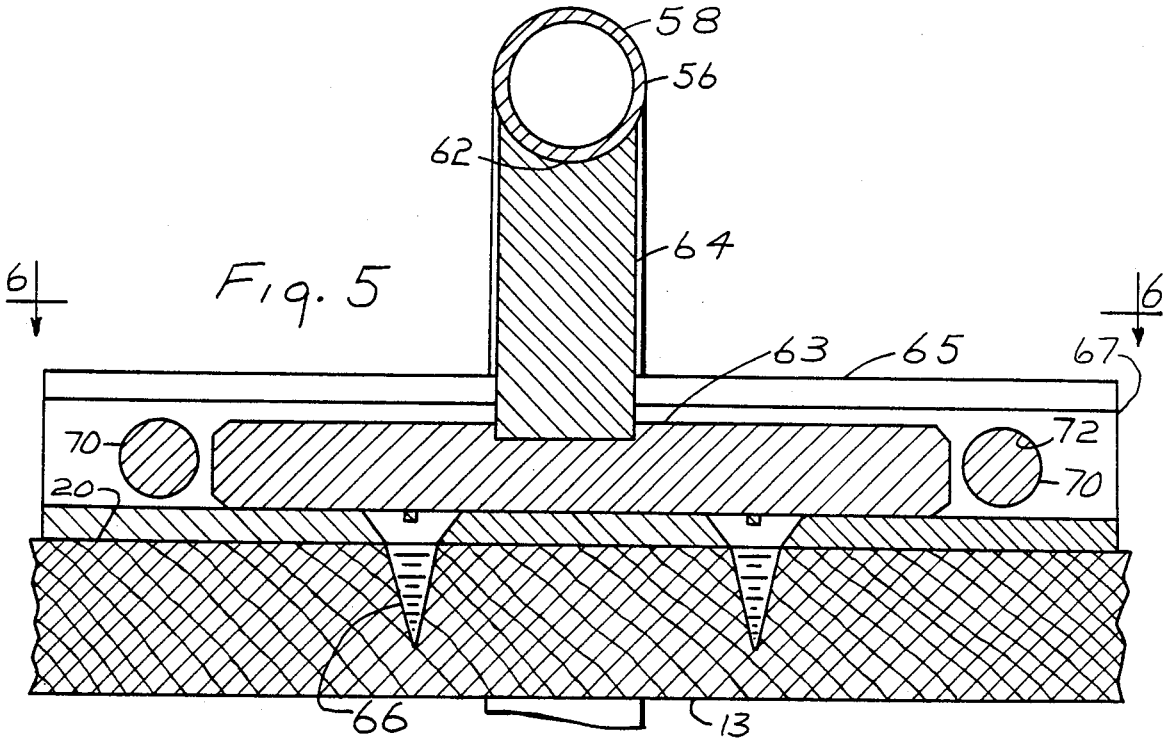
FIG. 5 is an enlarged vertical section taken generally along the Lines 5—5 of FIG. 4.

To facilitate attachment of the motor to the boat 11, the upper face 20 of the pulpit support member 13 is equipped with a pair of elongated and laterally spaced apart parallel channel members 65 that serve as receptacles for receiving the elements 63 as the motor 10 is being attached to the boat. FIGS. 5, 6 and 7 illustrate the structure of the receptacles 65 and how the elements 63 fit into the receptacles in attaching the motor 10 to the boat 11.

As seen in FIG. 5, each channel member 65 is secured to the upper face 20 of the pulpit support member 13 by a pair of screws 66. The arrangement is such that the channel members 65 are secured to the face 20 of the support member 13 in parallel and are horizontally spaced apart to accommodate reception of the elongated elements through the front open end 67 of the channel members 65. As the annular member 56 is passed over the end 17 of support 13 in securing the mounting device to the pulpit 12, the elements 63 can be aligned with the openings 67 in the channel members 65. Assuming that the retaining pins 70 to be subsequently described are withdrawn from the channel members 65 at this time, the elements 63 can be simultaneously passed through the front end openings 67 in the receptacles 65 and until the elements 63 are fully received in the channel members 65. Under such circumstances, each element 63 comes to rest on the bottom wall of the channel member 65 and the boat motor is suspended from the support member 13 of the pulpit and restrained from moving laterally through contact between the elongated elements 63 and the side walls of the channel members 65.

As will be seen in FIG. 7, each channel member 65 has a top wall 68 with an elongated slot 69 that is of sufficient size to accommodate the movement of the vertical member 64 as the elongated elements 63 are passed into a resting position in the receptacle 65 during attachment of the motor to the boat. On the other hand, the diameter of the element 63 is greater than the width of the slot 69 so that lateral withdrawal of an element 63 from a channel member 65 is prevented and such withdrawal is limited to a longitudinal movement of the element 63 through an end opening such as that designated at 67.

Each receptacle or channel member 65 is equipped with a pair of retaining pins 70 that, when inserted in the receptacle 65, limit the longitudinal movement of the elements 64 therein. These pins 70 extend through aligned holes 72 in the opposite side walls 71 of the channel member 65 and the pins are arranged, as seen in FIG. 6, to trap the elongated elements 63 in the channel between them. Each pin has an eye 73 at one end to facilitate finger manipulation of the pin and a small elongated element 74 that is pivotally mounted in a slot 75 at the other end of the pin for pivotal movement to a position transverse of the longitudinal axis of the pin. In the transverse position, element 74 serves as a stop to prevent withdrawal of the pins 70 through the holes 72 and from the member 65. The pivot pin 76 for each element 74 carries a pair of bent spring steel washers 77 at the opposite sides of the element 74 and which resist pivotal movement of the element 74 once it is placed in either a transverse or parallel position with respect to the axis of the pin 70.

Figure 8:
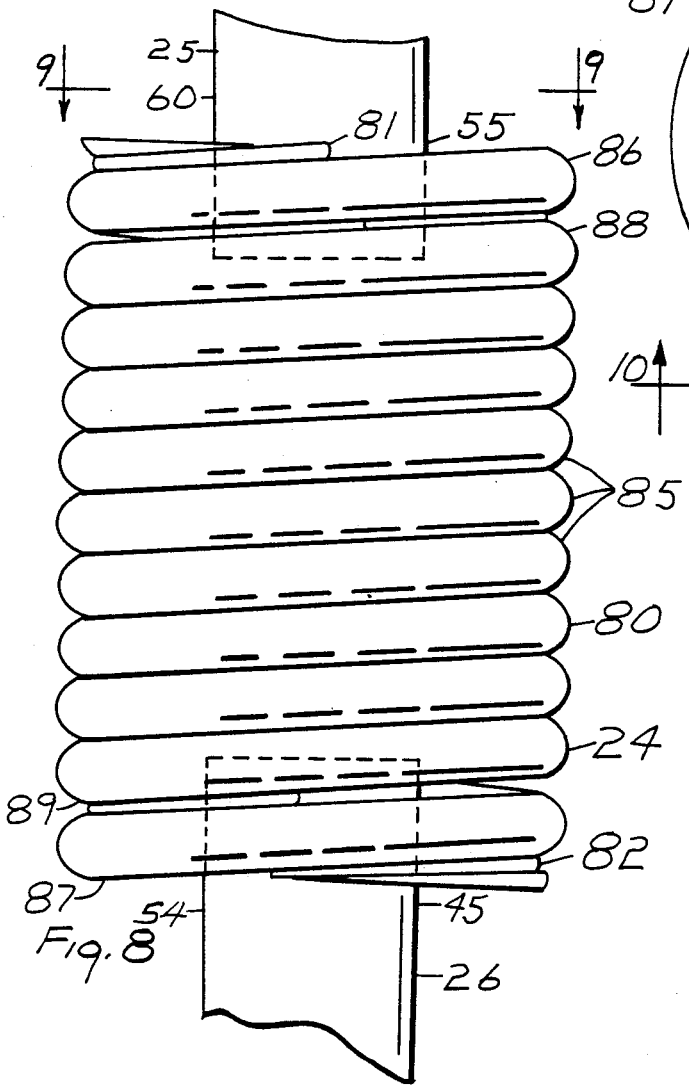
FIG. 8 is an enlarged side elevational view of a fragment of the device seen in FIG. 1 and more particularly of the structure forming the universal coupling and the adjacent structure to which it is attached.
Figure 9:
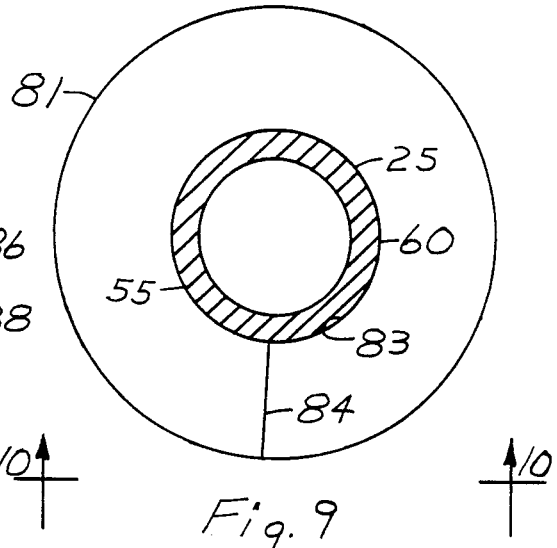
FIG. 9 is a horizontal sectional view taken generally along the Lines 9—9 of FIG. 8 with the convolutions of the spring removed so as to primarily show a configured annular member used in coupling the spring element to the upper section of the mounting device.
Figure 10:
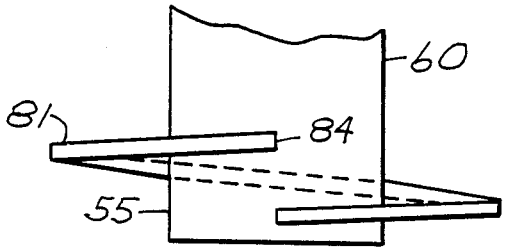
FIG. 10 is a vertical view of the fragment seen in FIG. 9 and as seen along the Lines 10—10 of FIG. 9.

The structure of the universal coupling 27 is best illustrated in FIGS. 8, 9 and 10. It includes a coiled tension spring element 80 and a pair of end members 81 and 82 which are suitably configured and respectively fixed to the tubular components 60 and 45 of the upper and lower sections of the mounting device 24. The structure of the members 81 and 82 is best seen by reference to FIGS. 8 and 9 and more particularly to the shape of end member 81 and its relation to tube member 60 of section 25.

Member 81 is annular, as seen in FIG. 9, so as to accommodate an arrangement in which the lower end 55 of the tubular member 60 is located in the center opening 83 thereof. In addition, the member 81 is cut along a radii such as indicated by the radial cut 84, and bent into the form of a helical convolution. As thus bent and arranged, the annular member 81 is welded to the lower end of the tubular component 60. Member 82 is similarly configured and fixed with respect to the upper end 54 of the large tubular component 45 of the telescoping assembly 44.

The shape of the annular members 81 and 82 facilitate the mounting of the tension spring element 80 between the spaced apart upper and lower sections 25 and 26. As seen in FIG. 8, element 80 is wound to provide a plurality of convolutions 85 that include opposite end convolutions 86 and 87. In assemblying the mounting device 24, the annular member 81 is screwed into the end of the coiled spring element 80 until it assumes a position between the upper end convolution 86 and the convolution 88 which is next adjacent thereto. The end convolution 86 may then be tack welded to member 81 to fix the spring element 80 to the member 81 and thereby prevent rotational movement of one with respect to the other. With the annular member 82 which is fixed to the lower section 26 is similarly fixed to the spring element 80, the member 82 is screwed into the lower end of the spring element 80 until the annular helically configured member 82 assumes a position between the lower end convolution 87 and the convolution 89 next adjacent thereto. Here, the spring element may again be suitably fixed to the member 82 by tack welding or by other suitable means so as to prevent relative rotational movement of one with respect to the other about the axis 61.

The action which transpires when the motor encounters an underwater obstruction is best depicted in FIG. 1. Here the normal position assumed by the motor assembly 22 and lower section 26 is designated at 92 and shown in solid lines. If movement of the boat 11 is such as to cause the motor assembly 22 to encounter the underwater obstruction designated at 93, the universal coupling 27 which connects the upper and lower sections 25 and 26 will permit the lower section 26 and its attached motor assembly 22 to pivot laterally and rearwardly of axis 61 as to the pivotal position designated in broken lines at 94 in FIG. 1. As this happens the tension spring arrangement of element 80 will exert a resistance to such pivotal movement and thus tend to urge the motor assembly and lower section back into their normal position 92 as the obstruction is removed.

FIG. 1 illustrates a situation where the pivotal movement is laterally rearwardly of the axis 61. However with the universal coupling arrangement provided the lower section 26 is capable of pivoting laterally of the axis 61 and universally in all directions normal to the axis. Thus the lower section 26 and motor assembly 22 are capable of being displaced laterally of the axis and generally throughout the region of a right conical zone having its apex in the region of the coupling 27. The DC motor may be connected through suitable switching to a DC power source onboard the boat in a conventional manner.

One may use other types of universal couplings such as those structured along the lines used as universal joints in drive trains of many automotive vehicles. However, in such cases, separate means, such as a compression or tension spring, must be used to urge the lower section to return to its normal position when it pivots therefrom.

While only certain preferred embodiments of this invention have been shown and described by way of illustration, many modifications will occur to those skilled in the art and it is, therefore, desired that it be understood that it is intended herein to cover all such modifications that fall within the true spirit and scope of this invention.

What is claimed as new and what it is desired to secure by Letters Patent of the United States is:

1. In an outboard boat motor that has an electric motor assembly which is submersible in water, and a mounting device for suspending the motor assembly from a boat, the improved mounting device comprising upper and lower sections which are spaced apart along an axis that is fixed with respect to said upper section, said upper section being attachable to a boat, said lower section having opposite ends and being secured to said motor assembly at one of said opposite ends, and means mounted at the other of said opposite ends and providing a universal coupling along the axis between said upper and lower sections for pivotal movement of the lower section universally laterally of said axis, said coupling including yieldable means that resist such lateral pivotal movement of the lower section with respect to said axis.

2. In an outboard boat motor that has an electric motor assembly which is submersible in water, and a mounting device for suspending the motor assembly from a boat, the improved mounting device in accord with claim 1 wherein said yieldable means is a coiled spring element.

3. In an outboard boat motor that has an electric motor assembly which is submersible in water, and a mounting device for suspending the motor assembly from a boat, the improved mounting device in accord with claim 1 wherein said yieldable means is a coiled tension spring element.

4. In an outboard boat motor that has an electric motor assembly which is submersible in water, and a mounting device for suspending the motor assembly from a boat, the improved mounting device in accord with claim 1 wherein said universal coupling includes a coiled tension spring element with opposite end convolutions, and means secured to the respective end convolutions and connecting the end convolutions to the upper and lower sections respectively.

5. In an outboard boat motor that has an electric motor assembly which is submersible in water, and a mounting device for suspending the motor assembly from a boat, the improved mounting device in accord with claim 1 wherein said yieldable means is a coiled tension spring element that is coaxially arranged with respect to said axis and has a plurality of convolutions that include a pair of opposite end convolutions, and said coupling means further includes a pair of flat, annular members that are respectively secured to said upper and lower sections, each of said annular members being bent into the form of a helical convolution and being arranged between a respective one of said opposite end convolutions and another of said plurality of convolutions next adjacent thereto.

6. In a boat with an outboard boat motor that has an electric motor assembly which is submersible in water, and a mounting device for suspending the motor assembly from the boat, the improvement wherein said boat has a bow pulpit with an elongated, flat support member that projects forwardly of the bow of said boat, said mounting device comprises upper and lower sections which are spaced apart along a vertical axis that is fixed with respect to said upper section, said upper section being attached to said support member of the bow pulpit, said lower section having upper and lower ends, said motor assembly being secured to said lower section at its lower end, a propeller drivingly connected to said motor assembly, means mounted at the upper end of the lower section and providing a universal coupling along said axis between said upper and lower sections for pivotal movement of the lower section universally laterally of said axis, said coupling including yieldable means that resists such lateral pivotal movement of the lower section with respect to said axis, and said motor assembly and propeller being arranged to exert thrust laterally of said boat.

7. In a boat with an outboard boat motor that has an electric motor assembly which is submersible in water, and a mounting device for suspending the motor assembly from the boat, the improvement in accord with claim 6 wherein said support member has an upper face and a pair of elongated and laterally spaced apart receptacles that are secured to the support member on said face, said upper section has a pair of horizontally and laterally spaced apart elongated elements that are received in the respective receptacles and therewith prevent transverse movement of the upper section with respect to said support member.

8. In a boat with an outboard boat motor that has an electric motor assembly which is submersible in water, and a mounting device for suspending the motor assembly from the boat, the improvement in accord with claim 6 wherein said support member has a pair of elongated and laterally spaced apart channel members that are secured thereto, said upper section has a pair of horizontally and laterally spaced apart elongated elements that are received in the channel members and therewith prevent transverse movement of the upper section with respect to said support member, each of said channel members being shaped to prevent the lateral withdrawal therefrom of the elongated element received therein and having an open end through which the element is received thereby.

9. In a boat with an outboard boat motor that has an electric motor assembly which is submersible in water, and a mounting device for suspending the motor assembly from the boat, the improvement wherein said boat has a bow pulpit with an elongated, flat, horizontally arranged support member that projects forwardly of the bow of the boat and has an upper face and a forward end, said mounting device comprises upper and lower sections which are spaced apart along a vertical axis that is fixed with respect to said upper section, and means providing a universal coupling along said axis between said upper and lower sections for pivotal movement of the lower section universally laterally of said vertical axis, said upper section having an annular member that is equipped with a pair of horizontally and laterally spaced apart elongated elements that are fixed in parallel with each other in the opening of the annular member, said support member and annular member being arranged so that the support member extends through the opening of the annular member, and the annular member rests thereon between the bow of the boat and the forward end of said support member, said support member having a pair of elongated and laterally spaced apart channel members that are secured to the upper face thereof and in which said elongated elements are respectively received and secured, said coupling including yieldable means that resist such lateral pivotal movement of the lower section with respect to said axis, said lower section having upper and lower ends and being secured to said motor assembly at its lower end, and a propeller drivingly connected to said motor assembly and arranged to exert thrust laterally of said boat.

10. In a boat with an outboard boat motor that has an electric motor assembly which is submersible in water, and a mounting device for suspending the motor assembly from the boat, the improvement in accord with claim 9 wherein said lower section has members that are telescopingly adjustable to vary the distance between said upper and lower ends, and means manipulatable to secure the telescoping members in a selected state of telescopic adjustment.

* * * * *